United States Patent [19]

Hanson et al.

[11] Patent Number: 4,996,906

[45] Date of Patent: Mar. 5, 1991

[54] ACTUATING ASSEMBLY FOR HYDRAULIC ELEVATORS

[75] Inventors: Wallace A. Hanson; Jeff Newman, both of Riverdale, Ga.

[73] Assignee: United Elevator Corporation, Riverdale, Ga.

[21] Appl. No.: 342,370

[22] Filed: Apr. 24, 1989

[51] Int. Cl.[5] ..... F15B 15/20

[52] U.S. Cl. ..... 91/392; 91/417 R

[58] Field of Search ..... 91/392, 396, 417 R

[56] References Cited

U.S. PATENT DOCUMENTS 2,463,537 3/1949 Hoar et al. ..... 91/392 X 3,568,571 3/1971 Hoen et al. ..... 91/396 X 4,026,523 5/1977 Gratzmuller ..... 91/396 X

*Primary Examiner*—William E. Wayner

*Attorney, Agent, or Firm*—Hurt, Richardson, Garner, Todd & Cadenhead

[57] ABSTRACT

An actuating assembly having a cylinder which receives a plunger defining a fluid restricting means along its lower end. A feed conduit delivers pressurized fluid through a fluid inlet and into the cylinder, which displaces the plunger out of the cylinder. As the plunger is displaced, the fluid restricting means progressively covers the fluid inlet, progressively restricting the rate of fluid flow into the cylinder, and slowing the plunger's displacement.

16 Claims, 4 Drawing Sheets

ACTUATING ASSEMBLY FOR HYDRAULIC ELEVATORS

BACKGROUND OF THE INVENTION

1. Field of the Invention

This invention relates to a hydraulic piston and cylinder assembly for raising and lowering an elevator or platform. The rate of upward movement of a plunger, which can be selectively moved upwardly or downwardly within a cylinder and which supports the elevator within the elevator shaft, is slowed as the plunger reaches its maximum displacement from the cylinder.

2. Description of the Prior Art

In the operation of a hydraulic elevator, the elevator is typically supported in its shaft by a plunger received in cylinder. The plunger is moved upwardly and downwardly within the cylinder by hydraulic fluid, which is pumped into and out of the cylinder through a fluid conduit. As fluid is pumped into the cylinder, the plunger is displaced and thereby raised. The plunger is lowered by either pumping the fluid out of the cylinder or by opening a relief valve in the fluid conduit. When the plunger is raised to a position approximating its maximum height, a speed reduction device is usually employed to decelerate the rate of upward movement of the plunger as it approaches its full extension. This prevents the elevator from stopping abruptly when the plunger is displaced to its maximum extent from the cylinder.

U.S. Pat. No. 2,981,236 discloses a safety device for hydraulic elevators using a hydraulic cylinder and ram, which prevents over-travel of the ram at the upper end of the cylinder. This reference discloses a mechanism for exerting hydraulic back-pressure on the ram as it approaches its limit of upward travel, even though the hydraulic mechanism is continuing to supply liquid under pressure to the cylinder. The back-pressure is created by utilizing a tapered safety ring in the upper end of the cylinder and an outwardly extending cushion ring on the lower end of the ram. As the ram approaches the maximum extent of travel, the cushion ring moves into the safety ring thereby creating back-pressure. A slow-down of the ram is thus accomplished using different elements and method than that disclosed in the present invention.

U.S. Pat. No. 1,011,338 discloses a bottom automatic stop limit for plunger-type elevators. In this reference, a plunger travels through a cylinder which has a tapered sleeve disposed in the cylinder's bottom portion. The tapered bottom portion of the cylinder slows the traveling speed of the plunger as liquid is forced out more slowly from the narrowed bottom. In other embodiments, the bottom portion of the plunger is perforated to further regulate its speed.

U.S. Pat. No. 2,719,510 discloses a cushion construction for air cylinders. A cushion of air arrests the piston as it reaches the end of its stroke, by means of sealing plugs attached to each end of the piston. When the piston reaches the end of its stroke, the sealing plug blocks the port and the release of air, thus the piston is arrested by the air trapped between the end of the cylinder and the piston. This device is only applicable to air cylinders, because of its dependence upon the greater elastic properties of gases.

U.S. Pat. No. 2,710,595 discloses a fluid operated cylinder (hydraulic and pneumatic) in which either one or both ends of the cylinder are provided with adjustable cushions.

None of the known prior art contains all of the features and meets all of the objectives of the present invention. That is, to provide a support plunger or piston and cylinder assembly in which the flow rate of fluid into the cylinder is selectively and progressively decreased by the action of the plunger, as the plunger is raised. Further, the references of the prior art do not disclose such a speed reduction assembly which includes means to center the plunger concentrically within the cylinder and to prevent scarring of the plunger upon removal.

SUMMARY OF THE INVENTION

The preferred embodiment of the actuating assembly for hydraulic elevators as described herein is characterized by a piston or plunger received in a cylinder. The plunger is moved upwardly and downwardly by its displacement by hydraulic fluid which is pumped both into and out of the cylinder through a fluid conduit. An elongated stop ring defining an upper abutment surface is disposed around the lower end of the plunger. As hydraulic fluid is pumped into the cylinder, the plunger is displaced and thereby raised. As the plunger approaches its maximum height, the stop ring passes across a chamber in the cylinder wall, into which the fluid conduit delivers hydraulic fluid, thereby limiting the amount of fluid entering the cylinder, and progressively slowing the plunger until the chamber is substantially sealed off. A ring of an elastomeric material is disposed around the interior of the cylinder wall to center the plunger, and a sleeve of a flexible or low-friction material borders the edges of the flange which defines the chamber, so that the plunger is not scarred as it moves within the cylinder.

Accordingly, it is an object of the present invention to provide an actuating assembly for hydraulic elevators which is efficient in operation, durable in structure, and inexpensive to manufacture.

Another object of the present invention to provide an actuating assembly for hydraulic elevators, in which a plunger is gradually, progressively decelerated as the elevator reaches its maximum height.

Another object of the present invention to provide an actuating assembly for hydraulic elevators which maintains the plunger in a centered position within the cylinder, and which avoids scratching of the plunger as it moves within the cylinder and when removed from the cylinder.

Another object of the present invention is to provide an actuating assembly for hydraulic elevators in which the rate of displacement of the plunger from a cylinder is controlled by controlling the rate of the fluid entering the cylinder.

Another object of the present invention is to provide an actuating assembly for hydraulic elevators in which a plunger assembly accomplishes the dual purpose of raising a platform or elevator and restricting the flow of hydraulic fluid into the cylinder.

Another object of the present invention is to provide an actuating assembly for hydraulic elevators in which the rate of flow of hydraulic fluid into the cylinder is progressively decreased as the plunger assembly is raised or displaced from the cylinder.

Another object of the present invention is to provide an actuating assembly for hydraulic elevators in which the rate of displacement of the plunger assembly can be selectively decreased.

Another object of the present invention is to provide an actuating assembly for hydraulic elevators which can either be mounted with a large portion of its cylinder underground, or which can be mounted entirely above ground, as desired.

Another object of the present invention is to provide a method for controlling the displacement rate of the plunger assembly from a cylinder, in which the rate of displacement of its maximum height.

Another object of the present invention is to provide a method for controlling the displacement rate of a plunger assembly from a cylinder, whereby the rate of displacement of the plunger from the cylinder is controlled by selectively controlling the flow rate of fluid into the cylinder.

Another object of the present invention is to provide a method for controlling the displacement rate of the plunger assembly from a cylinder, in which the deceleration of the plunger out of the cylinder can be selectively increased.

Other objects, features and advantages of the present invention will become apparent from the following description when taken in conjunction with the accompanying drawings, wherein like characters of reference designate corresponding parts throughout the several views.

DESCRIPTION OF THE PREFERRED EMBODIMENT

Figure 1:
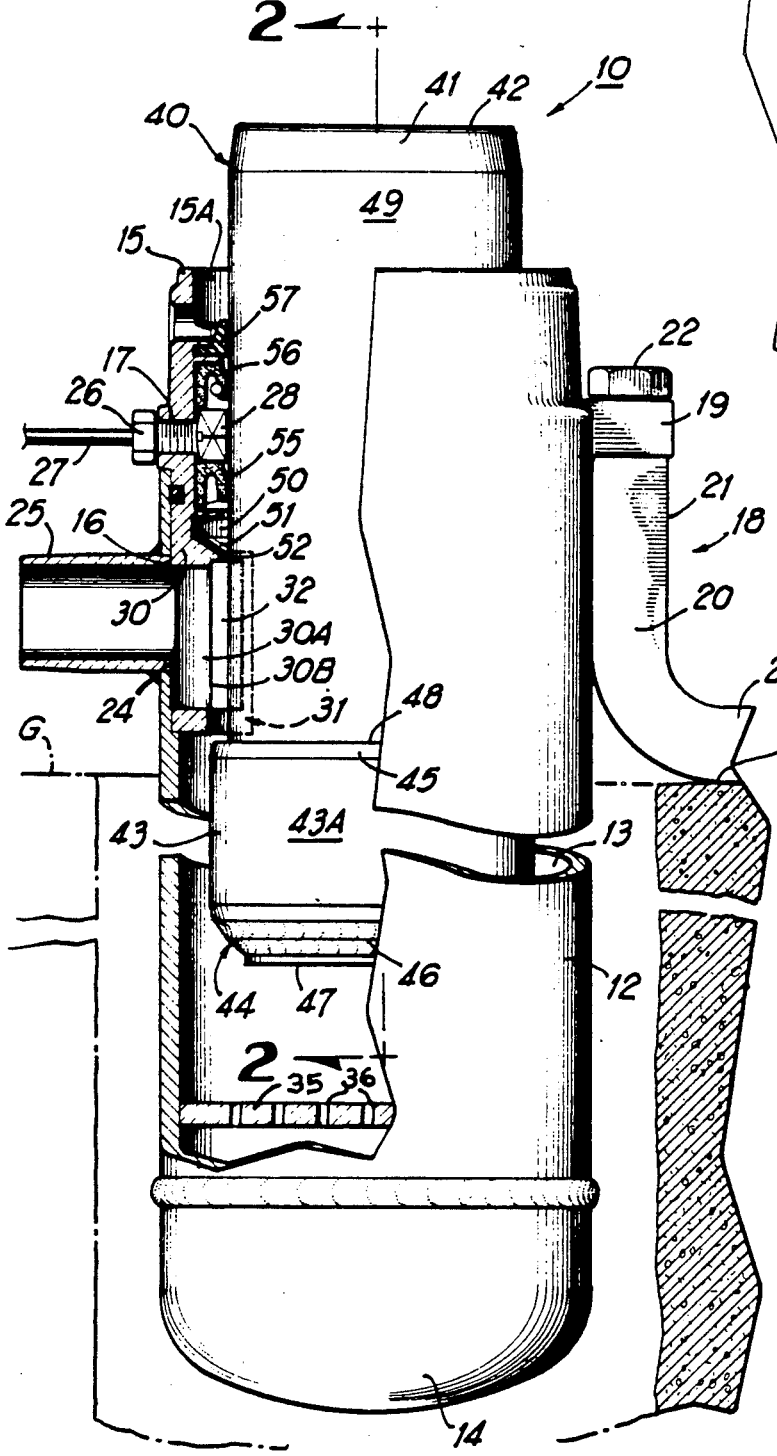
FIG. 1 shows a perspective view, with a partial cross-sectional view, of a first embodiment of the present invention.

Referring now in detail to the embodiments chosen for the purpose of illustrating the present invention, FIG. 1 depicts an actuating assembly 10 for raising and lowering a hydraulic elevator (not shown). Actuating assembly 10 includes upstanding, elongate, tubular cylinder 11 having annular side wall 12 defining chamber 13. Cylinder 11 includes closed, lower end or bulkhead 14 and opposed, annular upper edge 15 defining upper, open end 15A. The first embodiment depicted in FIG. 1 illustrates an actuating assembly 10 designed so that any desired lower portion of cylinder 11, including the lower end 14, is received in a cavity below ground level G. Side wall 12 of cylinder 11 defines opening or inlet port 16 which is positioned above ground level G. Side wall 12 also defines lubricant opening 17, positioned above port 16. Cylinder 12 of assembly 10 is immovably fixed in a vertical position by support assembly 18. Any suitable support assembly well known in the art such as support assembly 18 can be used. For purposes of illustration, however, support assembly 18 includes retaining collar 19, which is integrally mounted to exterior or outer surface of side wall 12, opposite ports 16 and 17. Support brace 20, preferably made of a right-angled, solid steel bar, includes upstanding arm 21 which is received within annular collar 19 and held thereto by end cap 22 which is threaded onto external threads (not shown) of arm 21. Support brace 20 also includes horizontally extending arm 23, which is attached to surface G by any suitable means (not shown) well known in the art. More than one such support assembly 18 can be used to support actuating assembly 10. It is therefore seen that cylinder 11 is immovably retained by support assembly 18 with lower end 14 below ground surface G and upper edge 15 disposed above ground surface G, so that ports 16 and 17 and annular retaining collar 19 are all spaced above ground surface G.

Received around the periphery of port 16 in sealed relationship therewith is one end 24 of fluid conduit 25. The other end of fluid conduit 25 is attached to a hydraulic fluid pump (not shown), for delivering hydraulic fluid through fluid conduit 25 and into chamber 13 of cylinder 11, as discussed hereinafter. Received in side wall 12 through port 17 is lubrication fitting 26, which is connected to bleeder line 27. Lubricating guide bearing 28 is attached to fitting 26, opposite bleeder line 27, within chamber 13. As is well known in the art, bleeder line 27 connects to a selected point along fluid conduit 25 so that a small amount of hydraulic fluid or oil passes through line 27 and fitting 26, and into lubricating guide bearing 28.

Figure 2:
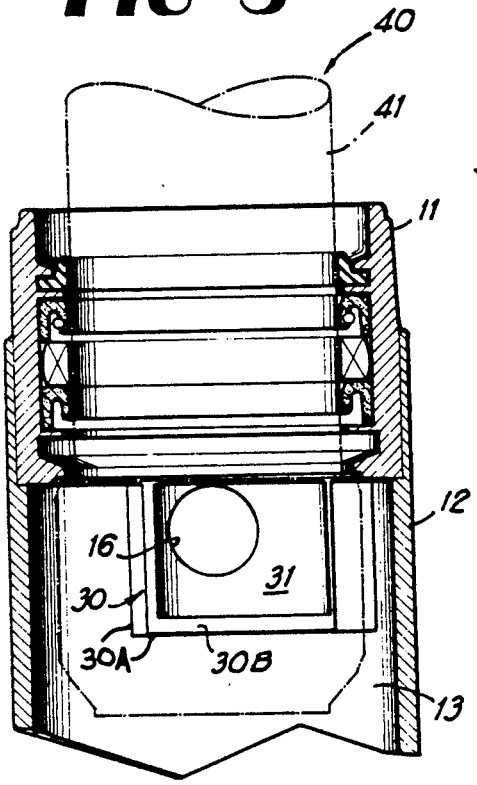
FIG. 2 is a cross-sectional view taken along lines 2—2 of FIG. 1.

Along the interior of side wall 12, spaced around port 16, is rectangular-shaped flange 30. Rectangular flange 30 is oriented so that its longer dimension is vertically aligned, and its shorter dimension is horizontally aligned. Bottom wall 31 attaches to flange 30, and is curved, being of the same curvature as that of side wall 12 of cylinder 11. Side walls 30A of flange 30 extend inwardly of side wall 12 and bottom wall 31 to define fluid chamber 32, and terminate in smooth, curved end walls 30B, which face inwardly toward the interior of chamber 13. As shown in FIG. 2, port 16 defined by side wall 12 of cylinder 11 is arranged to one side of bottom wall 31 within chamber 32. This eccentric positioning of port 16 causes the hydraulic fluid flowing from chamber 32 to swirl as it is forced into chamber 13, which aids in the even distribution of the hydraulic fluid within chamber 13. This also assists in maintaining plunger assembly 40 concentrically between annular side wall 12 is horizontally disposed, flat, disc-shaped plate 35, defining spaced passageways 36 therethrough. Plate 35 is spaced upwardly from bottom end 14 of cylinder 11.

Received in cylinder 11 in concentric, longitudinal relationship therewith, is piston rod assembly or plunger assembly 40. Plunger assembly 40 includes cylindrical, smooth-surfaced piston rod or plunger 41 having flat, plannar, upper support surface 42 at one end, and defining cylindrical stop ring 43 at its opposite end. An elevator or platform (not shown) is supported by upper support surface 42 of plunger 41. Stop ring 43 is integrally formed at the lower end 44 of plunger 41, and includes outer, cylindrical, smooth-surfaced wall 43A, and is concentric with plunger 41. Stop ring 43 includes upper, inwardly-angled, tapered surface 45 terminating in horizontally disposed abutment surface or edge 48. Stop ring 43 also includes lower, inwardly angled, tapered surface 46 which terminates in flat, plannar, lower abutment surface 47. The diameter of stop ring 43 is larger than the diameter of plunger 41, as shown in FIG. 1. The diameter and curvature of cylindrical stop ring 43 are such that when stop ring 43 is longitudinally disposed within cylinder 11 so that it is positioned adjacent to chamber 32, chamber 32 is substantially, but not totally sealed from communication with chamber 13. The longitudinal dimension of wall 43A is greater than the longer dimension of rectangular flange 31. Preferably, when stop ring 43 is positioned adjacent to surface 30B, approximately 95% of chamber 32 will be closed off from communication with chamber 13. The exact amount of occlusion is not critical to the operability of the invention, however, such amount will affect the rate at which plunger assembly 40 is decelerated, as is hereinafter discussed.

Plunger assembly 40 moves upwardly and downwardly, concentrically within cylinder 11, but cannot rock from side to side or rotate within chamber 11. Positioned within chamber 11 just above the top edge of flange 31 which defines chamber 32, as shown in FIG. 1, is impact ring 50. Impact ring 50 is securely attached to the interior of side wall 12 of cylinder 11 so as to be immovable therein. Impact ring 50 includes downwardly tapering lower surface 51 which terminates in lower abutment surface 52. The purpose of impact ring 50 is to engage the upper edge 48 of stop ring 43 when plunger assembly 40 is raised to the proper extent, thereby halting the upward travel of assembly 40. Since impact ring 50 is positioned just above the top edge of chamber 32, when lower abutment surface 52 of impact ring 50 engages upper surface 48 of stop ring 43, cylindrical stop ring 43 is positioned directly adjacent to chamber 32, and extends from the uppermost portion or top edge of flange 31, past the lowermost portion or bottom edge of flange 31 along the lower end of chamber 32.

Plate 35 engages bottom surface 47 of stop ring 43 when plunger assembly 40 is in its lowermost position, thereby restricting the downward travel of plunger assembly 40 in chamber 11. It is, therefore, obvious that plunger assembly 40 moves upwardly and downwardly within cylinder 11, and its extent of travel in cylinder 11 is limited by the longitudinal distance between the top of plate 35 and bottom edge 52 of impact ring 50, minus the longitudinal distance between abutment surface 48 and surface 47. As shown in FIG. 1 in fragmentary form, cylinder 11 and plunger assembly 40 can be designed so that any desired distance between plate 35 and lower edge 52 can be accomplished through selected manufacture of actuating assembly 10.

Figure 1A:
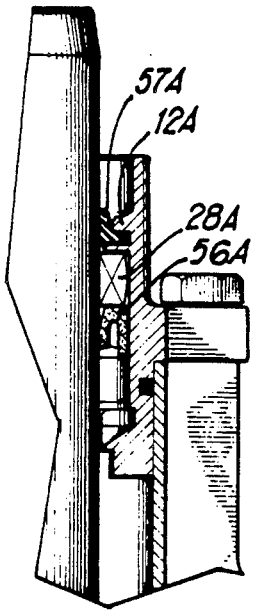
FIG. 1A is a fragmentary, partial cross-sectional view of alternative packing means and wiper means.

Positioned above impact ring 50 is lower seal or packing 55, which forms a seal above the impact ring 50, thereby preventing the movement of hydraulic fluid within chamber 13 upwardly past packing 55. Packing such as packing 55 is conventional and well known in the art. Upper seal or packing 56 is positioned above lubricating guide bearing 28 and prevents hydraulic fluid from guide bearing 28 to pass upwardly within chamber 13 past upper packing 56. Wiper 57 is positioned above packing 56 within cylinder 11 and below upper edge 15 of cylinder 11, to wipe any dirt, dust, or other foreign matter from the cylindrical, smooth surface 49 of plunger 41. Since packings 55 and 56 and wiper 57 are well known in the art, other, similar arrangements are also known and may be employed. FIG. 1A depicts wiper 57A positioned below lip 12A, and packing 56A positioned below guide bearing 28A, to exemplify another such arrangement which will perform satisfactorily in the present invention.

In operation, initially, hydraulic fluid is pumped under pressure by any suitable hydraulic fluid pump through fluid conduit 25 and into chamber 32. The hydraulic fluid pump and the controls associated therewith are not shown or described herein. However, it is well known in the art to provide appropriately controlled hydraulic fluid pump means to deliver pressurized fluid at selected flow rates to the inlet of a cylinder assembly, for supporting a hydraulically controlled elevator. The hydraulic fluid then flows downwardly within chamber 13 and around plunger assembly 40. The fluid passes downwardly through passageways 36 in plate 35 until the area of chamber 13 below plate 35 fills, and the fluid thereafter fills chamber 13 around assembly 40. The pressurized fluid is restricted within chamber 13 by packing 55, and under normal operating conditions, chamber 13 is filled with hydraulic fluid below packing 55 around plunger assembly 40. A suitable bleeder line and relief valve are provided below packing 55 to vent any air or fluid from chamber 13, as is well known in the art. Therefore, since the hydraulic fluid is pumped under pressure into chamber 13, the continued influx of fluid into chamber 13 tends to displace assembly 40 by pushing assembly 40 upwardly out of cylinder 11. Since the area within chamber 13 below packing 55 is constant, as is the area occupied in chamber 13 below packing 55 by plunger 41, the rate at which fluid flows into chamber 13 through conduit 25 is constant at given pump pressure, until assembly 40 is raised sufficiently so that stop ring 43 begins to progressively cover rectangular chamber 32. As stop ring covers rectangular chamber 32, the rate of influx of hydraulic fluid into chamber 13 is slowed because the amount of chamber 32 communicating with chamber 13 is occluded or decreased. Since upstanding rectangular chamber 32 is symmetrical, the upward rate of assembly 40 out of cylinder 11 is also slowed proportionally. As assembly 40 continues to rise at a relatively slower rate, stop ring 43 progressively covers more and more of rectangular chamber 32, thereby progressively decreasing the rate of fluid flow into chamber 13. It is, therefore, obvious that the rate of upward displacement of assembly 40 out of cylinder 11 will become progressively slower until assembly 40 is displayed to its full extent. This full displacement occurs when abutment surface 48 of stop ring 43 contacts lower edge 52 of impact ring 50. When these respective surfaces come in contact, impact ring 43 fully covers chamber 32 from the top edge of flange 31 to and including the bottom edge of flange 31, since the longitudinal dimension of stop ring 43 is longer than the distance from the top of chamber 32 to the bottom of chamber 32, as shown in FIG. 1. The surface 43A of stop ring 43 is always spaced from edges 30B of flange 31 so that rectangular chamber 32 is never completely closed off from chamber 13. This permits fluid to move into and out of chamber 13, depending upon the action of the hydraulic fluid pump (not shown). The pressure exerted on the hydraulic fluid by the pump operates to selectively control the movement of plunger assembly 40 into or out of cylinder 11. The distance between surface 30B of flange 30 and surface 43A of stop ring 43 obviously will affect the rate of fluid flow from chamber 32 into chamber 13.

Practically, a platform, such as an elevator (not shown), is attached to the top surface 42 of assembly 40 so that such platform can be raised or lowered by movement of assembly 40 within cylinder 11. As the platform is raised to its uppermost extent, the above-referenced interaction of stop ring 43 with the influx of hydraulic fluid into chamber 13 through cavity 32 will cause the upper movement of the platform to progressively slow until plunger 40 reaches its uppermost extent. This prevents the platform from being stopped abruptly as plunger 40 reaches its uppermost position.

The platform is lowered by permitting assembly 40 to displace the hydraulic fluid out of chamber 13 through fluid conduit 25. The hydraulic fluid pump (not shown) pumps the hydraulic fluid out of chamber 13. Plate 35 prevents the stop ring 43 from contacting the bottom 14 of cylinder 11, thereby assuring that some hydraulic fluid is always below bottom surface 47 of stop ring 43.

Figure 3:
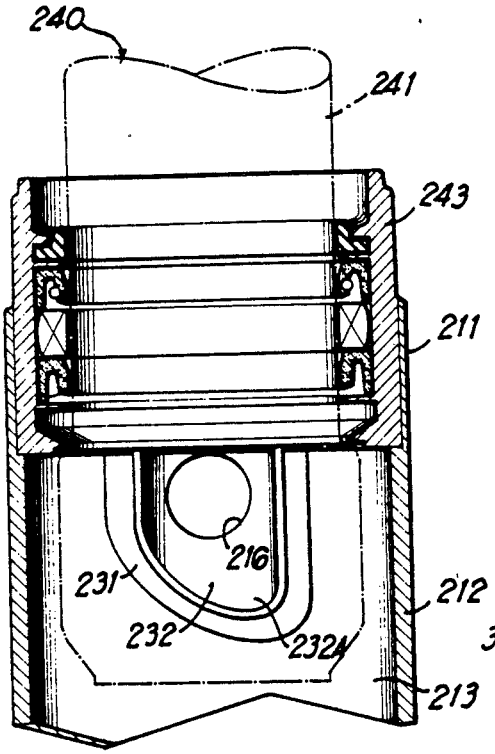
FIG. 3 is a cross-sectional view similar to FIG. 2, showing a second embodiment of the present invention.

A second embodiment of the present invention is shown in FIG. 3, wherein chamber 232 includes a lowerly extending, progressively decreasing tapered portion 232A, rather than being an entirely symmetrical, rectangular chamber, such as chamber 32. All remaining elements are identical in structure to and function to those elements discussed in reference to the first embodiment. In the second embodiment, however, as the plunger assembly 240 is raised within cylinder 211, the stop ring 243 will initially cover chamber 232 at tapered portion 232A. Since tapered portion 232A of chamber 232 is smaller in area than the rectangular portion of chamber 232, the rate of fluid restricted from flowing from cavity 232 into chamber 213 when stop ring 243 covers tapered portion 232A, is less than that described in reference to the first embodiment when the stop ring 43 covers a symmetrical, rectangular chamber 32. Therefore, the plunger assembly 240 is decelerated relatively slower at first, then at an increasing rate as the stop ring 243 progressively covers more of chamber 232. The rate of deceleration of assembly 240 can be selectively controlled by the design of the area of tapered portion 232A. This second embodiment merely allows the plunger assembly 240 to begin decelerating at a slower rate.

Figure 4:
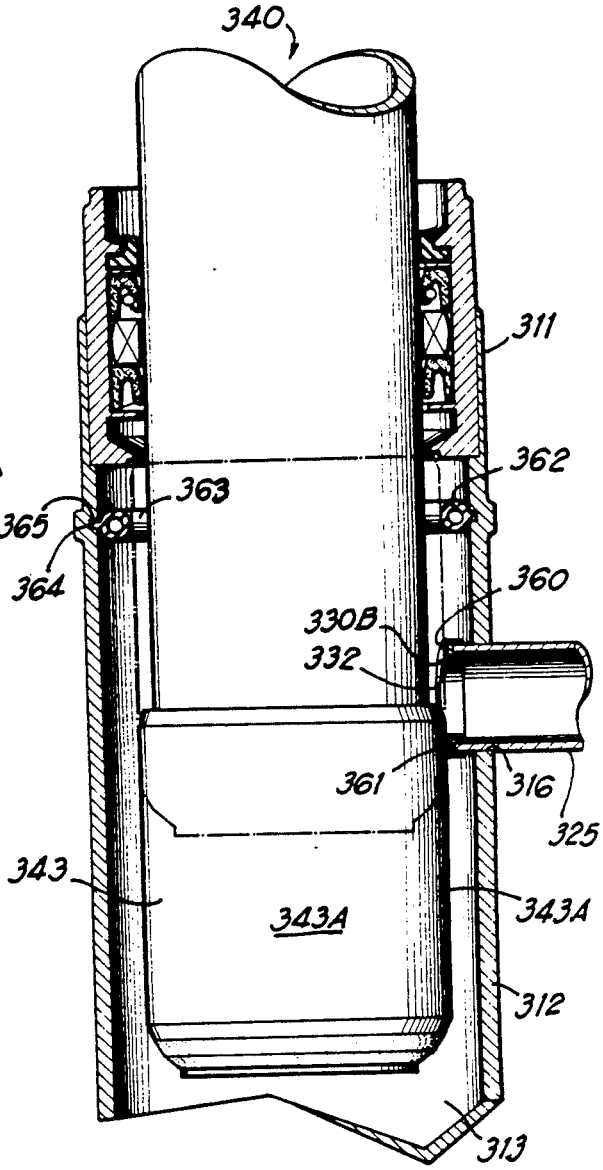
FIG. 4 is a partial cross-sectional view of a third embodiment of the present invention.

In a third embodiment, the fluid inlet 325 extends through side wall 312 and into chamber 313 of cylinder 311, as shown in FIG. 4. A protective sleeve 360 covers the inner edge 361 of fluid conduit 325, in order to protect the smooth surface 343A of stop ring 343 from scaring. Further, an annular, tubular extrusion 362 having an inner, smooth, arcuate surface 363 and an outer lip 364 is positioned above inlet 325, so that lip 364 is received within channel 365 defined in wall 312 of cylinder 311. This tubular extrusion 362 assists in preventing the plunger assembly 340 from becoming scratched by contact with the interior of side wall 312 when the assembly 340 is removed, for example, for maintenance. Sleeve 360 and tubular extrussion 362 are preferably made of a flexible material such as synthetic rubber or low friction PVC. Further, elements corresponding to sleeve 360 and tubular extrusion 362 can be incorporated into any of the previous embodiments herein described.

The embodiment shown in FIG. 4 accomplishes a deceleration of the upward movement of assembly 340 in a similar manner to that of the embodiments referenced above. As assembly 340 is displaced upwardly, out of cylinder 311 by the hydraulic fluid, stop ring 343 will progressively cover the opening 332 of fluid conduit 325, thereby restricting the amount of hydraulic fluid flowing into chamber 313. As opening 332 is progressively covered by stop ring 343, the rate that the hydraulic fluid entering chamber 313 is progressively lessened, and therefore the rate of movement of the assembly 340 out of cylinder 311 is correspondingly, progressively slowed. The side wall 343A of stop ring 343 is spaced from the outer peripheral surface 330B of fluid conduit 325 to permit some movement of hydraulic fluid past stop ring 343, even when outlet 332 of fluid conduit 325 is completely covered by stop ring 343, identically as described in reference to the previous embodiments. All other elements described in relation to the previous embodiments, with the exception of rectangular cavity 32, are included in this fourth embodiment and function identically thereto.

Figure 5:
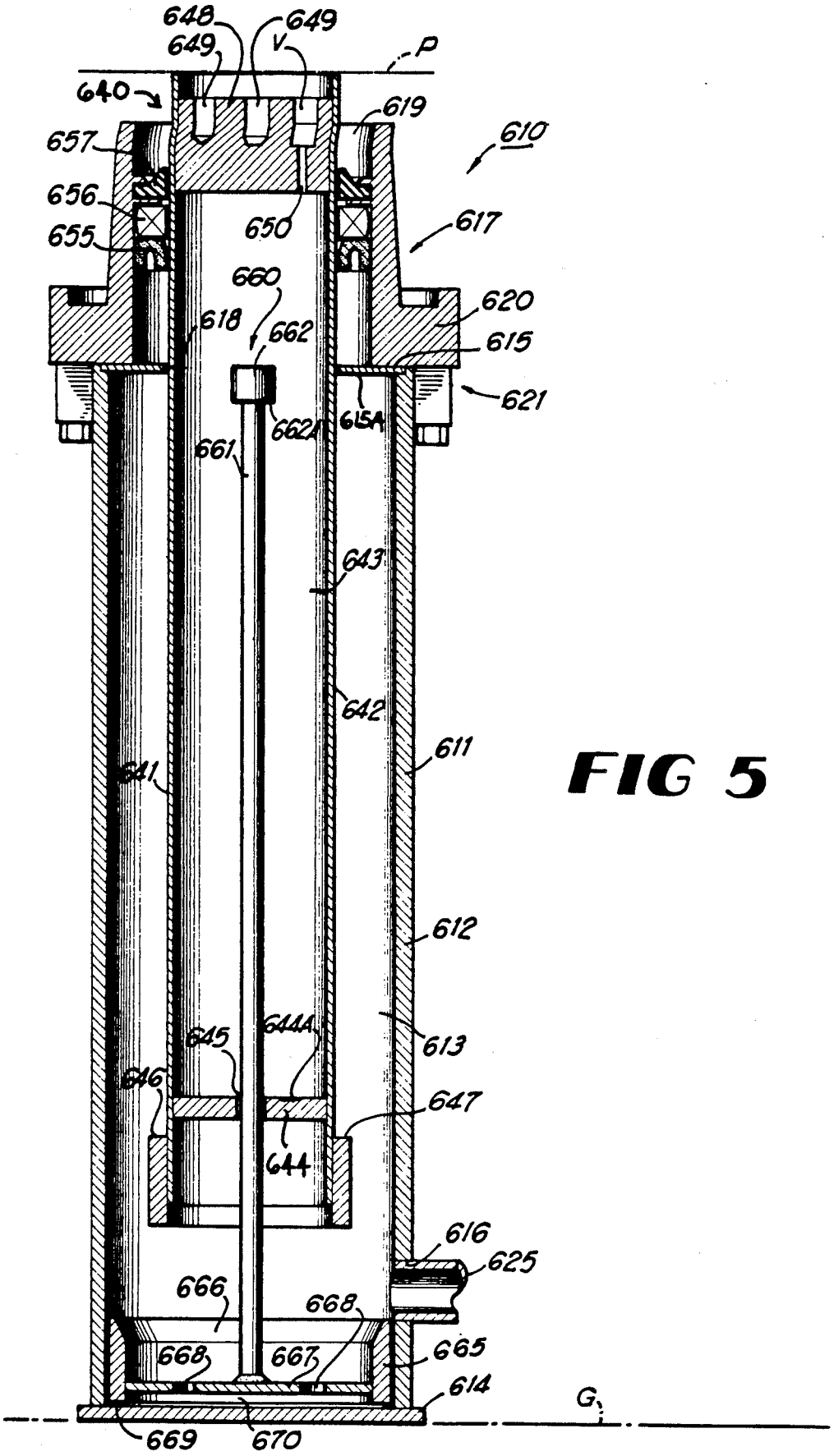
FIG. 5 is a partial cross-sectional view of a fourth embodiment of the present invention.
Figure 6:
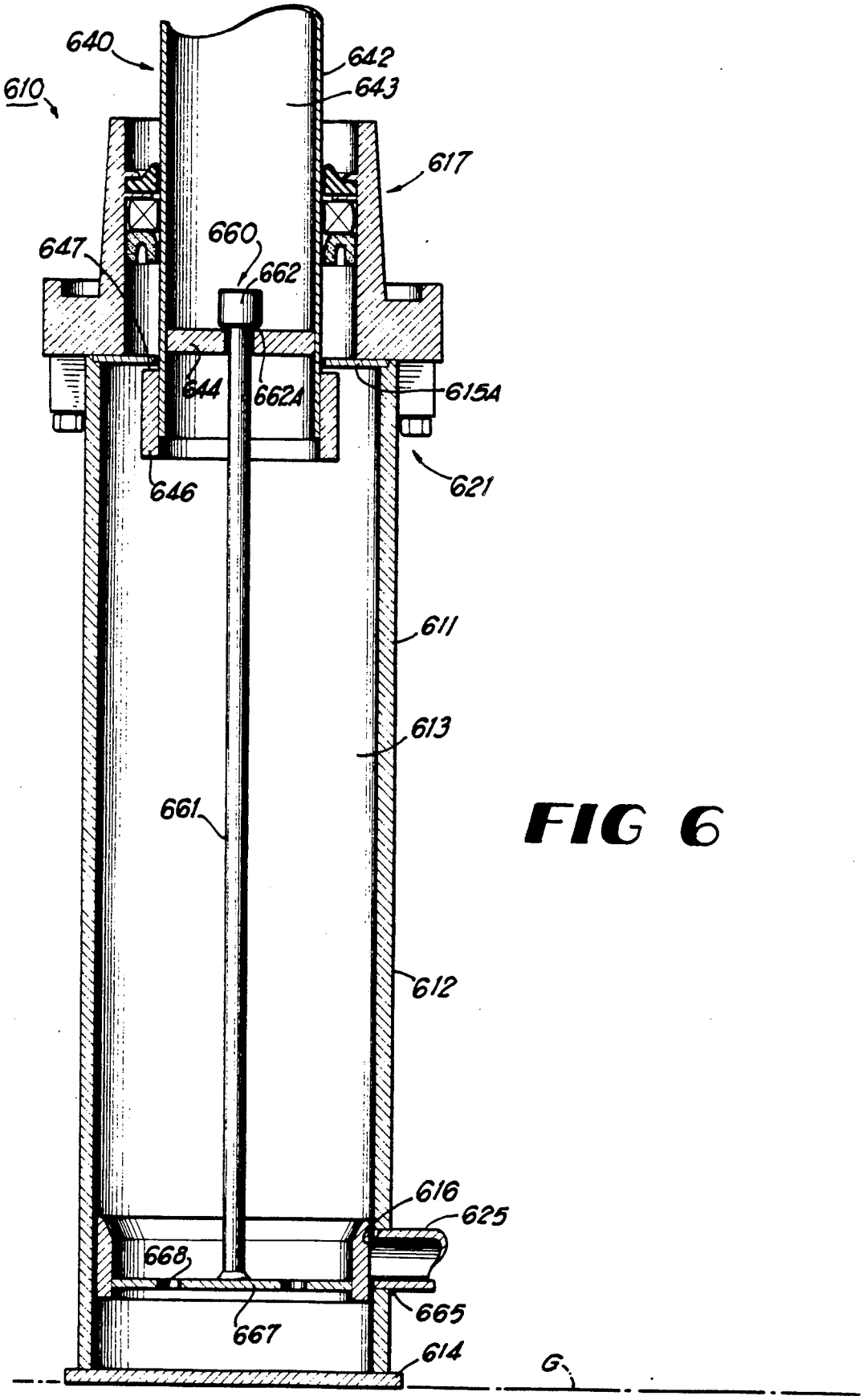
FIG. 6 is a partial cross-sectional view of the embodiment of FIG. 5 showing the maximum upward extension of the plunger of the fifth embodiment of the present invention.

A fourth embodiment of the present invention is shown in FIGS. 5 and 6. This embodiment can be used when the assembly 610 does not have to be received below the surface of the ground G, as is necessary in the above-described embodiments. This fifth embodiment is used, for example, when the assembly 610 can be placed in a basement or an upper floor of a building, and the platform P is intended to be raised upwardly from the basement or upper floor, respectively.

FIG. 5 shows actuating assembly 610 having upstanding, elongate, tubular cylinder 611, with side wall 612 which defines chamber 613 therein. Attached in sealing relationship to the bottom portion of wall 612 is bottom wall 614, which effectively seals chamber 613 at the bottom of cylinder 611. Any suitable support means well known in the art can be utilized to assist in securely maintaining assembly 610 in an upright, vertical position. Disposed along the top edge of wall 612 is flat, planar, annular top wall 615 which defines concentrically therein circular aperture 618. Aperture 618 is disposed concentrically with respect to cylinder 611, as shown in FIG. 5. Side wall 612 also defines port 616 along its lower portion. Mounted on top of the upper edge of side wall 612 and additionally supported by top wall 615 is head assembly 617. Assembly 617 is tubular and longitudinally disposed with respect to cylinder 611, and defines longitudinal passageway 619 therein, which is concentrically aligned with chamber 613 in cylinder 611. Head assembly 617 also includes annular, laterally extending flange 620 along its lower side. Head suitable means such as securing means 621, however, various other means for securing head assembly 617 to cylinder 611 are well known in the art, and can alternatively be used.

Plunger assembly 640 includes hollow, cylindrical, tubular plunger 641 having side walls 642 and defining hollow chamber 643 therein. Disc-shaped alignment plate 644 having planar, upper abutment surface 644A is mounted to the interior portion of side wall 642 along the lower portion of plunger 641, as shown in FIG. 5. Alignment plate 644 defines centrally disposed, circular aperture 645 therethrough. Securely mounted to the outer portion of side wall 642 along its lowermost end is stop ring 646. Stop ring 646 is in the form of an annular collar mounted around the bottom, exterior portion of plunger 641, such as by welding or other securing means, and defines shoulder 647 along its upper side. Bulkhead 648 is mounted to interior portion of side wall 642 at the uppermost end of plunger 641. Bulkhead 648 defines internally threaded bores 649 and bleeder passageway 650 having one-way relief valve V therein. A platform or elevator P is supported at the upper end of plunger 641 and is attached to bulkhead 648 by externally threaded pins received in bores 649 or other commonly-known mounting means.

Disposed within chamber 619 of head assembly 617 is packing 655, lubricating guide bearings 656, and wiper 657. These elements correspond to their associated elements in the above-described embodiments and perform the identical functions described therewith.

Plunger 641, therefore, moves upwardly and downwardly within chamber 613 of cylinder 611 and is concentrically aligned therewith. Also disposed within chamber 613 is lifting rod assembly 660. Lifting rod assembly 660 includes solid, elongated lifting rod 661, which is cylindrical and disposed longitudinally within chamber 613. Lifting rod assembly 660 includes boss or stop 662 securely mounted to its top end. Boss 662 has annular abutment surface 662A around lifting rod 661. Lifting rod 661 passes freely through circular aperture 645 of plate 644, and is welded at its lower end to plate 667 of fluid restricting ring 665. Restricting ring 665 includes smooth upstanding annular side wall 666, the outer diameter of which is slightly less than the inner diameter of cylinder 611. Plate 667 is welded to the lower, interior portion of side wall 666, and defines passageways 668 therethrough. Plate 667 is welded to side wall 666 above the bottom edge 669 of side wall 666 so that a variable area chamber 670 is always defined below plate 667. For the purposes of the present embodiment, plate 667 could instead be in the form of a bar extending from one side of wall 666 to the diametric opposite side of wall 666 and still perform satisfactory. However, lifting rod 661 must be welded to plate 667 so that rod 661 is in concentric alignment with cylinder 611 and plunger 641, passing freely through aperture 645.

In operation, hydraulic fluid is pumped under pressure into cylinder 611 through fluid conduit 625. The hydraulic fluid fills both chamber 613 of cylinder 611 and chamber 643 of plunger 641. As these chambers are filled with fluid, any air contained therein is displaced and relieved through bleeder line 650 and through one-way valve V to the atmosphere. Under normal operating conditions, chambers 613 and 643 are filled with hydraulic fluid. When chambers 613 and 643 become filled with fluid, the continued inflow of pressurized fluid through conduit 616 causes plunger 641 to become displaced from 641 approaches its uppermost extent of travel or greatest displacement from cylinder 611, upper, planar surface 644A of alignment plate 644 abuts lower abutment surface 662A of boss 662. As plunger 641 continues to rise, lifting rod assembly 660 rises therewith until restricting ring 665 is pulled upwardly to progressively cover port 616, thereby progressively decreasing the rate of fluid flowing into cylinder 611. As the rate of fluid is thereby decreased, the rate of displacement of plunger 64 out of cylinder 611 is similarly, proportionally decreased. As Plunger 64 continues to rise, ring 665 fully covers port 616, as depicted in FIG. 6. Actuating assembly 610 is proportionately designed so that when ring 665 fully covers port 616, abutment surface 647 abuts lower surface 615A of top plate 615, thereby halting the upper movement of both plunger 641 and lifting rod assembly 660.

As in the embodiments previously discussed, even when ring 665 fully covers port 616, there is a space between port 616 and side wall 666 of ring 665 so that port 616 is never completely closed off, and hydraulic fluid can always flow into or out of cylinder 611 through fluid conduit 625. It is obvious, therefore, that the rate at which the plunger 641 is displaced from cylinder 611 is controlled by restricting fluid flow into cylinder 611 in a manner similar to the previously described embodiments.

Plunger 641 is lowered by pumping hydraulic fluid out of cylinder 611 using the hydraulic fluid pump (not shown). As plunger 641 retracts back into cylinder 611, abutment surface 644A of alignment plate 644 will disengage from shoulder 662A of boss 662. Lifting assembly 660 will then settle by gravity downward toward base plate 614, the hydraulic fluid in chamber 613 below plate 667 passing upwardly through passageways 668. As lifting assembly 660 drops, the port 616 is progressively uncovered, allowing more communication between port 616 and chamber 613, and therefore, more hydraulic fluid to be pumped out of chamber 613 at a faster rate.

It will further be obvious to those skilled in the art that many variations may be made in the above embodiments here chosen for the purpose of illustrating the present invention, and full result may be had to the doctrine of equivalents without departing from the scope of the present invention, as defined by the appended claims.

What is claimed is:

1. An actuating assembly for hydraulic elevators comprising:

(a) a cylinder having a side wall, a bottom wall, and defining a chamber therein, wherein the top of said cylinder defines an opening;

(b) a plunger received through said opening into said cylinder and which can be partially displaced from said cylinder;

(c) fluid inlet means in said side wall of said cylinder for channeling fluid into said cylinder;

(d) pump means connected to said fluid inlet means for supplying fluid under pressure to said cylinder through said fluid inlet means; and (e) fluid restricting means disposed along said plunger for progressively restricting the supply of fluid entering said cylinder as said plunger is displaced from said cylinder.

2. The actuating assembly defined in claim 1, wherein said fluid restricting means includes an annular collar, disposed at the lower end of said plunger.

3. The actuating assembly defined in claim 1, wherein said fluid inlet means includes a chamber along the interior of said cylinder side wall.

4. The actuating assembly defined in claim 1, and abutment means disposed along the interior side wall of said cylinder, for halting the movement of said plunger when said plunger is displaced a predetermined extent from said cylinder.

5. The actuating assembly defined in claim 1, and packing means disposed along the interior side wall of said cylinder above said fluid inlet means for restricting the fluid in said cylinder, below said packing means.

6. The actuating assembly defined in claim 5, and wiper means disposed along the interior side wall of said cylinder above said packing means, for wiping debris from the outer surface of said plunger.

7. The actuating assembly defined in claim 1, wherein said cylinder is partially received below the surface of the ground.

8. The actuating assembly defined in claim 1, and guide bearing means mounted along the interior of said cylinder side wall for maintaining said plunger concentrically within said cylinder.

9. The actuating assembly defined in claim 1, wherein said fluid inlet means comprises a rectangular-shaped chamber.

10. The actuating assembly defined in claim 9, wherein said chamber includes side walls and bottom wall defining an inlet port.

11. The actuating assembly defined in claim 9, wherein said rectangular chamber includes a tapered portion extending downwardly therefrom.

12. An actuating assembly for hydraulic elevators, comprising:

(a) a-cylinder having a side wall, a bottom wall and defining a first chamber, wherein the top of said cylinder defines an opening;

(b) a fluid inlet means defined in said cylinder side wall for supplying fluid into said first chamber;

(c) a plunger, having a side wall defining a second chamber, received through said opening into said cylinder, and which can be partially displaced from said cylinder;

(d) a lifting rod assembly disposed in said cylinder and extending into said second chamber and having a fluid restricting means disposed along one end; and (e) pump means for supplying pressurized fluid through said fluid inlet means and into said cylinder for displacing said plunger from said cylinder, whereby as said plunger is displaced, said plunger moves said lifting rod assembly so that said fluid restricting means progressively covers said fluid inlet means.

13. The actuating assembly defined in claim 12, and a head assembly mounted onto said cylinder and having a side wall defining a central passageway, packing disposed around the interior of said side wall and a wiper mounted around the interior of said side wall above said packing.

14. The actuating assembly defined in claim 12, and a bulkhead disposed along the interior side wall of said plunger.

15. The actuating assembly defined in claim 12, wherein said lifting rod assembly includes a lifting rod, and a boss mounted to one end of said lifting rod opposite said fluid restricting means.

16. The actuating assembly defined in claim 12, wherein said actuating assembly is designed to be mounted above the surface of the ground.

* * * * *